US005655885A

United States Patent [19]

Chung

[11] Patent Number: 5,655,885

[45] Date of Patent: Aug. 12, 1997

[54] RECIPROCATING PISTON PUMP WITH MODULAR FLUID SUBASSEMBLY

[76] Inventor: Yang Woong Chung, 20555 E. Candler Ct., Walnut, Calif. 91789

[21] Appl. No.: 415,674

[22] Filed: Mar. 31, 1995

[51] Int. Cl.[6] ..... F04B 53/16

[52] U.S. Cl. ..... 417/44.2; 417/360; 417/548; 417/554; 92/255; 92/128

[58] Field of Search ..... 417/44.2, 360, 417/435, 440, 454, 548, 549, 554, 569; 92/255, 257, 128

[56] References Cited

U.S. PATENT DOCUMENTS

| | | | |
|---|---|---|---|
| 388,943 | 9/1888 | Woodward et al. | 417/554 |
| 629,002 | 7/1899 | Coryell | 417/435 |
| 681,828 | 9/1901 | Krohn | 417/548 |
| 1,524,222 | 1/1925 | Warner . | |
| 1,539,556 | 5/1925 | Garber | 417/554 |
| 1,602,193 | 10/1926 | Garber | 417/549 |
| 2,658,485 | 11/1953 | Dreyer | 417/435 |
| 2,675,759 | 4/1954 | Yarger | 417/554 |
| 3,220,354 | 11/1965 | Sutliff . | |
| 3,446,156 | 5/1969 | Lightfoot | 417/554 |
| 3,502,029 | 3/1970 | Halladay . | |
| 3,684,410 | 8/1972 | Fitzgerald et al. . | |
| 3,787,149 | 1/1974 | Dane et al. . | |
| 3,906,845 | 9/1975 | Wegmann . | |
| 4,086,936 | 5/1978 | Vork . | |
| 4,185,543 | 1/1980 | Ides | 92/128 |
| 5,228,842 | 7/1993 | Guebeli et al. . | |
| 5,282,722 | 2/1994 | Beatty | 417/44.2 |
| 5,292,232 | 3/1994 | Krohn et al. | 417/44.2 |

OTHER PUBLICATIONS

SB-15-632, pp. 13-18, showing parts list for QFH Airless Spray Pump (no date).

Parts list for Campbell Haufeld sprayer.

Owners Manual for Epic 440e, Titan Tool, Inc., Oakland, NJ (1989).

Owner's Manual for 1075 Pro Pak Airless Paint Sprayer Model No. 0288050, Wagner Spray Tech Corp., Minneapolis, MN (1989).

Part Sheet 2303R-3 for Binks Humdinger 2 Model 41-12880 Floor Mount Unit and Model 12881 Wheel Mount Unit Electric Airless Spray Painting Machine, Binks Mfg. Co., Franklin Park, IL (1989).

Amspray Part Sheets Nos., 40044, 40028, 40517, 40615, 40671, 40904, 40905, 40250, 40252, 07500, 12000, 08100, 40901, 40991, 40715, 04301 for Corsair Cart & General Assembly (Feb. 1985 to Jan. 1989).

Safety, Operating and Maintenance Instructions and Parts List for H.E.R.O. Model 633 Airless Paint Sprayer, H.E.R.O. Industries Ltd., Custer, WA (no date).

Pp. 3-8 from parts catalog for Binks sprayers, Binks Mfg. Co. (1986).

Brochure for Titan airless pumps (in Korean language), 4 pages, Titan Tool Inc., Franklin Lakes, NJ (1992).

(List continued on next page.)

*Primary Examiner*—Timothy Thorpe
*Assistant Examiner*—Roland G. McAndrews, Jr.
*Attorney, Agent, or Firm*—Darby & Darby, P.C.

[57] ABSTRACT

A double-displacement pump is compact, has a modular fluid subassembly made up a substantially cylindrical pump body and a piston reciprocally driven within the pump body. An outlet fluid cavity is formed between the pump body and a surrounding housing structure, enabling the subassembly to be removed as a unit without the need to disconnect auxiliary systems, such as a pressure control system or a priming system. In a preferred embodiment, the subassembly is retained within the housing structure by an inlet fitting which includes a check valve. A second check valve is then provided in the piston itself, which has a stem threadingly engaged with a reciprocal drive element. A sleeve received over the stem serves to compress a fluid sealing structure against a flange of the piston when the stem is fully engaged with the drive element.

23 Claims, 3 Drawing Sheets

OTHER PUBLICATIONS

Brochure for Titan Epic Series Airless Piston Pumps, 4 pages, Titan Tool Inc., Franklin Lakes, NJ (1991).

Binks Professional Painting Equipment for Contractor and Industrial Maintenance, PMCCB–4, 12 page brochure, Binks Mfg. Co., Franklin Park, IL (1989).

Brochure for Avenger Excel Series airless piston sprayers, 2 pages, Amspray, Harrison, OH (1989).

Brochure for Little Pro 2400 Piston Airless Paint Sprayer, Form #001–304, 2 pages, Airlessco by Durotech Co., Moorpark, CA (no date).

Brochure for New Direct Drive Piston Pumps, 4 pages, Wagner Spray Tech Corp., Minneapolis, MN (1991).

Brochure for Airless Accessories, 4 pages, Wagner Spray Tech Corp., Minneapolis, MN (1992).

Brochure for 650 Airless Spraying System, 2 pages, Wagner Spray Tech Corp., Minneapolis, MN (1990).

Brochure for Model ED 1300 Airless Sprayer, 2 pages, Wagner Spray Tech Corp., Minneapolis, MN (1992).

Brochure for 1250 HP High Performance Airless Sprayer, 2 pages, Wagner Spray Tech Corp., Minneapolis MN (1993).

Brochure for 1075 Pro–Pak, 2 pages, Wagner Spray Tech Corp., Minneapolis, MN (1990).

Brochure for Capspray High Volume Low Pressure Paint Application Equipment, 8 pages, Wagner Spray Tech Corp., Minneapolis, MN (1992).

Brochure for Hero Proline Series, 2 pages, H.E.R.O. Industries Ltd., Custer, WA (no date).

Brochure for 660ex Titan Epic Series Airless Piston Pumps, 2 pages, Titan, Franklin Lakes, NJ (1993).

RECIPROCATING PISTON PUMP WITH MODULAR FLUID SUBASSEMBLY

BACKGROUND OF THE INVENTION

The invention relates to the field of high pressure fluid pumps and, more particularly, to a double-displacement piston-and-cylinder pump with a modular fluid subassembly for operation with paint and other liquids.

Double-displacement pumps, in which fluid is pumped during both strokes of a reciprocating two-stroke cycle, have been used to pressurize paint for airless spraying operations. The pressures required for these purposes put extreme demands on pump mechanisms, however, particularly their fluid sections, leading to high failure rates. They also cause the pumps to be rather large and expensive.

It is extremely difficult and time consuming to service the fluid section of a traditional double-displacement pump under field conditions. Prior fluid sections are not only complex, but also quite sensitive and difficult to replace without sophisticated tools. Replacing the fluid section of an airless paint sprayer typically requires that much of the pump and the fluid section be dismantled and meticulously reassembled. For these reasons, a painter using an airless system ordinarily must deliver the system to a technician for service whenever a failure or internal blockage occurs.

Additionally, it is desirable in some applications to feed paint to a pump from a hopper located above the pump. Diaphragm-type pumps have been used in such situations, but are not suitable for all uses. Piston-and-cylinder pumps are not widely used with hoppers because the excessive length of their fluid sections would require placing a hopper high off the ground, rendering the resulting system unstable.

Pressure control valves, priming valves and other special subsystems are also required in many high pressure pumping applications, increasing the complexity of the pumping system and complicating replacement of its fluid section. Each subsystem is normally connected to the pump housing by one or more separate conduits which must be disconnected and/or dismantled before any components of the fluid section can be removed.

Therefore, it is desirable in many applications to provide a double-displacement piston-and-cylinder type fluid pump that is compact, relatively simple, easy to service (particularly in the field), and can be readily used in a hopper configuration.

SUMMARY OF THE INVENTION

In the present invention, a novel and improved double-displacement pump has a modular fluid subassembly within a unitary housing. The subassembly can be replaced quickly and easily, even in the field, and contains a minimum of parts. To replace the subassembly, an inlet hose is disconnected from the pump, an upper fitting is removed to expose the subassembly, and a piston of the subassembly is rotated to disengage it from an associated drive element. With the piston disconnected, the modular subassembly can be lifted from the housing as a unit. Replacement is accomplished by simply sliding another subassembly into the housing and threading its piston into the drive element. The housing, which incorporates pressure control and priming valves, as well as the outlet port of the pump, remains affixed to a casing of the drive element throughout the removal and replacement process.

With the modular subassembly removed from its housing, the subassembly is disassembled by sliding a cylindrical outer sleeve off the piston to reveal the packing elements for service. This allows clogged or otherwise failing fluid sections to be replaced or serviced in the field, as required, and permits them to be repaired quickly and inexpensively.

Thus, the structure of the invention provides a compact modular subassembly that contains all of the high failure rate components of the fluid section, is serviceable in the field, and makes the piston packing immediately available for replacement once a sleeve is separated from the piston. Because the subassembly is compact and simple in structure, it is practical for a painter in the field to carry spares. This reduces down time attributable to malfunctioning pumps.

Construction of the pump with a unitary outer housing also reduces the complexity of the device and provides enough mass to support other systems, such as a priming subsystem. These subsystems communicate with the outlet of the pump through an annular cavity surrounding the cylindrical pump body. They need not be removed or disconnected to replace the modular subassembly.

Accordingly, a double-displacement fluid pump constructed according to the invention has: a reciprocating drive element; a pump housing adjacent the drive element, the pump housing having inner walls defining an opening therein; and a modular fluid subassembly including a substantially cylindrical pump body disposed within the opening, the pump body having outer walls defining an exterior surface and inner walls defining a pump bore, and a piston received within the pump bore and releasably coupled to the drive element for reciprocal movement therewith, the inner walls of the pump housing combining with the outer walls to form an outlet fluid cavity of the pump. In one embodiment, the piston is threadingly coupled to the drive element, the pump body is substantially cylindrical, and the outlet fluid cavity includes a substantially annular region at least partially surrounding the pump body. A pressure control apparatus then communicates with the outlet fluid cavity through the pump housing.

BRIEF DESCRIPTION OF THE DRAWINGS

The above and other features of the present invention may be more fully understood from the following detailed description, taken together with the accompanying drawings, wherein similar reference characters refer to similar elements throughout and in which.

DESCRIPTION OF THE PREFERRED EMBODIMENTS

Figure 1:
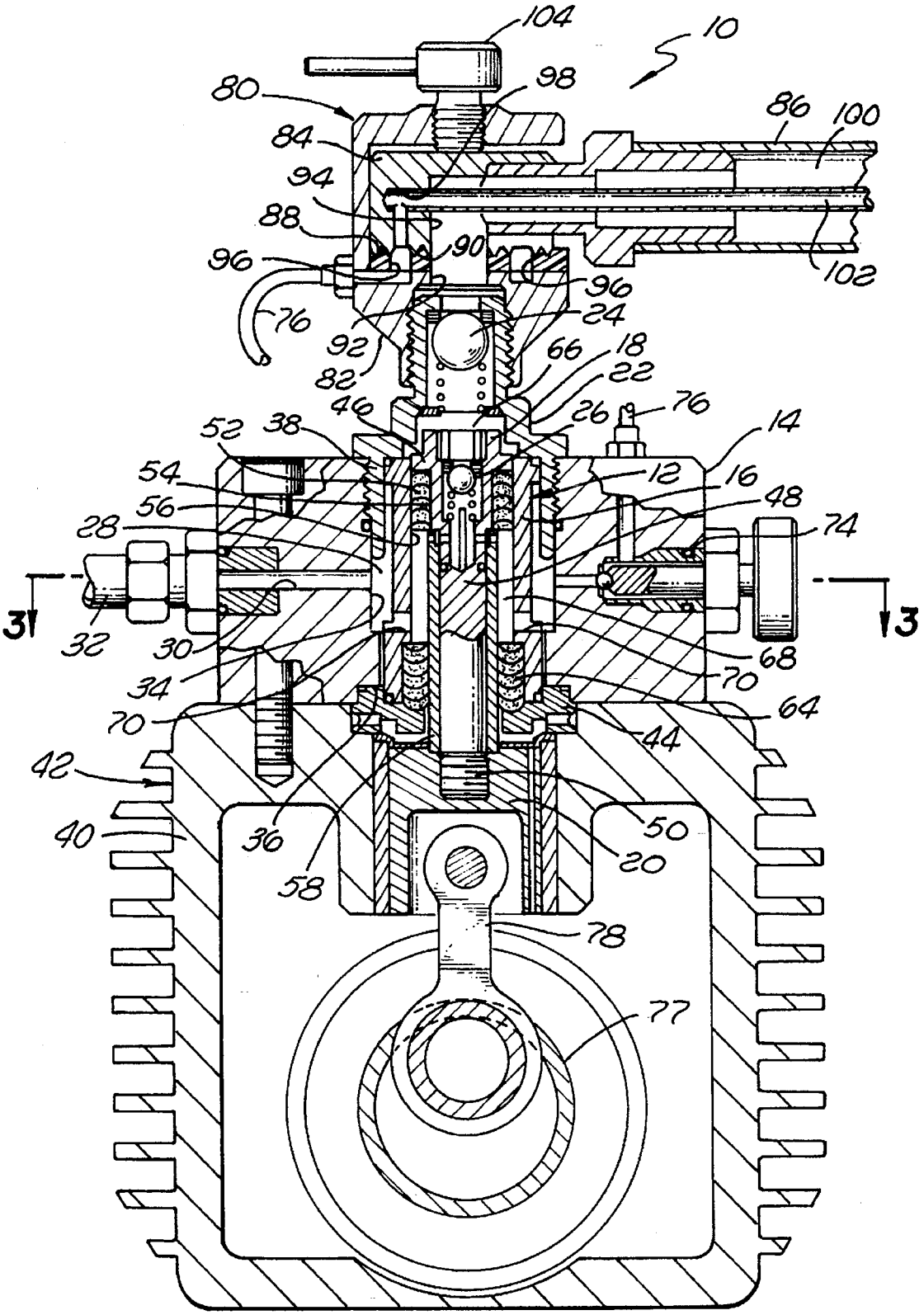
FIG. 1 is a fragmentary vertical sectional view of a double-displacement pump constructed according to one embodiment of the present invention.
Figure 2:
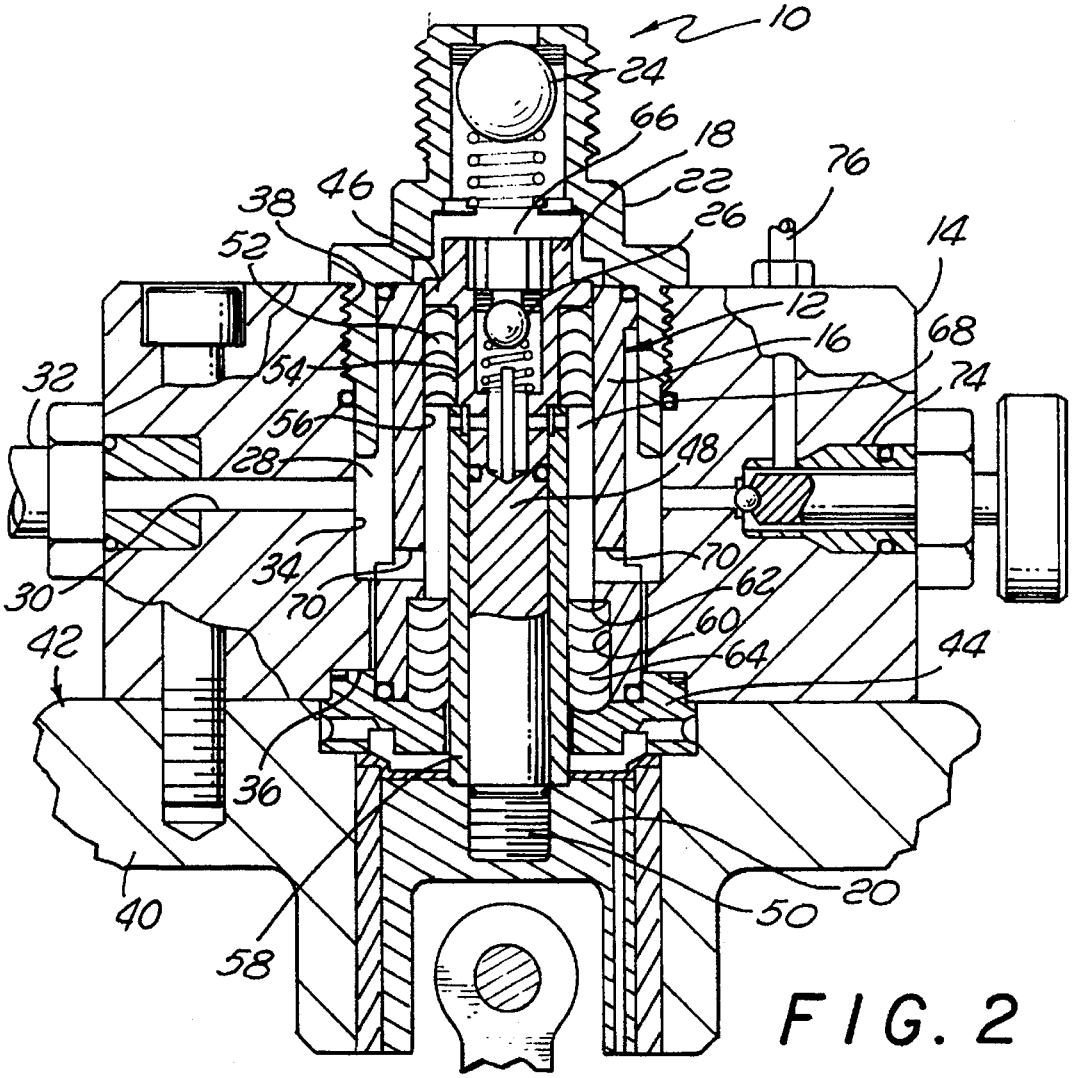
FIG. 2 is an enlarged fragmentary vertical sectional view of the double-displacement pump of FIG. 1.
Figure 3:
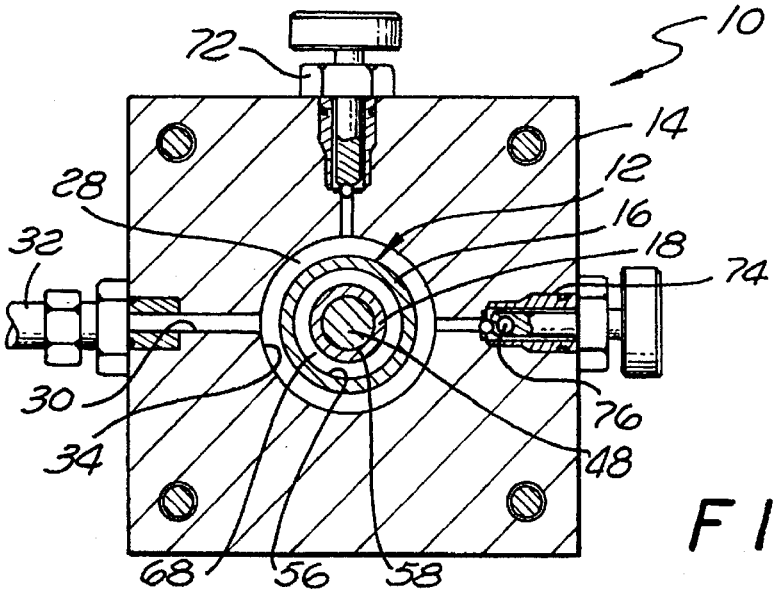
FIG. 3 is a horizontal sectional view taken along the line 3—3 of FIG. 1.

Referring now to the drawings, specifically FIGS. 1–3, a double-displacement pump 10 constructed according to a preferred embodiment of the invention has a modular fluid subassembly 12 received within an integral pump housing 14. The modular fluid subassembly 12 includes a substantially cylindrical pump body 16 surrounding a piston 18. The piston is coupled to a reciprocating drive element 20 to pump paint or other suitable liquid introduced via an inlet fitting 22. The pumping action is facilitated by a pair of check valves 24 and 26 of the inlet fitting 22 and the piston 18, respectively, causing fluid to be forced into an outlet fluid cavity 28 surrounding the pump housing 14. From the outlet fluid cavity, fluid passes through an outlet passage 30 to an outlet hose 32 leading to a spray gun or other suitable device requiring pressurized fluid (not shown).

The modular structure of the fluid subassembly 12 permits it to be removed and reinstalled easily, even in the field, simply by removing the inlet fitting 22, uncoupling the piston 18 from the reciprocating drive element 20 and withdrawing the fluid subassembly as a unit from the pump housing 14. In one embodiment, the piston 18 is threadingly coupled to the reciprocating drive element 20, permitting it to be uncoupled by rotating its upper end with a wrench.

Referring now to FIGS. 2 and 3 in more detail, the pump housing 14 is preferably a solid block of metal or other rigid material having substantially cylindrical inner walls 34 defining an opening extending from a first (lower) end 36 adjacent the drive element 20 to a second (upper) end 38 remote from the drive element and adjacent the inlet fitting 22. The pump housing is bolted to a crankcase 40 of a reciprocating drive mechanism 42 associated with the drive element 20. A seal plate 44 is sandwiched between the pump body and the crankcase to separate the interior of the pump body from the drive element while permitting the piston 18 to reciprocate therethrough. The pump body 16 is received axially within the pump housing 14 with its lower end forming a seal with the plate 44 and its piston 18 engaging the drive element 20. The upper end of the pump body 16 fits within and seals against the inlet fitting 22, which itself is sealed against the upper end 38 of the pump housing 14. Each of these seals can be achieved with o-rings, as shown in the drawings, or by any other suitable structures permitting removal and reinsertion of the modular fluid subassembly 12 without loss of sealing capacity.

As seen most clearly in FIG. 2, the piston 18 of the illustrated embodiment has a flange 46 at its upper end and a stem 48 forming an elongated shank directed downwardly and terminating in a threaded end portion 50 coupled to the drive element 20. An upper sealing structure 52 is disposed on an enlarged portion 54 of the stem 48 abutting the flange 46 to engage an interior pump bore 56 of the pump body in a fluid sealing relationship. The upper sealing structure 52 may be any suitable element, such as a packing made of leather or nylon. It is compressed against the flange 46 by a sleeve 58 which is confined between the enlarged portion 54 of the stem 48 and the drive element 20 when the piston is coupled to the drive element. The inner surface of the sleeve 58 is sealed relative to the outer surface of the stem 48 by an o-ring.

The outer surface of the sleeve 58 is sealed against a portion 60 of the pump bore having a diameter greater than the diameter of the remainder of the bore. For this purpose, the pump bore forms a step 62 between its two portions to receive a lower packing or other sealing structure 64 similar to the sealing structure 52 of the piston 18 and compress it against an upper surface of the seal plate 44.

Thus, an upper (primary) pump chamber 66 is formed within the pump bore 56 above the flange 46 of the piston 18, and a lower (secondary) pump chamber 68 is formed between the packings 52 and 64 within the annular space extending from pump bore to the sleeve 58. These two chambers act as described below to pump fluid from the inlet fitting 22 to the outlet fluid cavity 28 surrounding the pump body.

During the downstroke of the piston 18, a check valve 24 in the inlet fitting 22 permits paint to be drawn into the primary chamber 66 to fill that chamber. At the same time, the secondary chamber 68 decreases in volume, causing paint from that chamber to be expelled to the outlet cavity 28 through outlet openings 70 extending through the pump body 16. This fluid passes to a spray nozzle (not shown) through the outlet passage 30 and the outlet hose 32.

On the upstroke, the check valve 24 in the inlet fitting 22 closes and the check valve 26 in the piston 18 opens to pass fluid from the primary chamber 66 to the secondary chamber 68. Because the upper surface of the piston 18 has a cross-sectional area greater than the annular cross-sectional area of the secondary chamber 30, more fluid is forced from the primary chamber 66 than the secondary chamber 68 can hold. The additional fluid exits through the outlet openings 70, the outlet fluid cavity 28, the outlet passage 30 and the output hose 32, the same as during the downstroke, to deliver paint to the spray nozzle.

With specific reference to FIG. 3, the pump housing 14 surrounds the modular fluid subassembly 12 to form the outlet fluid cavity 28 through which all pumped fluid is expelled. Although the dimensions and shape of the cavity 28 can vary, it is preferably annular. In the illustrated embodiment, the volume of the outlet cavity 28 is increased by recessing both the inner walls 34 of the pump housing and the outer walls of the pump body 16 over at least a portion of their lengths (see FIG. 2).

Due to the substantial mass of the pump housing 14, it can contain a number of subsystems of the pump 10 which must communicate with the outlet side of the pump. Thus, a pressure control sensing device 72 of a pressure control subsystem (not separately shown) can be mounted within the pump housing 14 in communication with the outlet cavity 28. The sensing device can act to relieve pressure mechanically by passing excess fluid back to a fluid supply reservoir (not shown) or can provide quantitative pressure information to an electronic circuit (not shown) for controlling a motor driving the reciprocating drive element 20. The motor can be turned on and off electronically in this embodiment to maintain the pressure in the outlet cavity within a preselected narrow range.

Another device mounted within the integral pump housing 14 of the invention is a priming valve 74 for diverting the output of the pump back to the fluid supply reservoir through a return conduit 76 (FIG. 1). This device is used in the conventional way to prime the pump's fluid system on start-up.

Because auxiliary subsystems, such as the pressure control and priming subsystems described above, are connected to the outlet fluid cavity 28 through the pump housing 14, they need not be removed or disconnected in order to replace the modular fluid subassembly. Neither is it necessary to remove the outlet hose 32 connected to the outlet passage 30. This saves considerable time and effort when servicing the equipment and enables many routine service operations to be carried out in the field.

Referring again to FIG. 1, the crankcase 40 of the reciprocating drive mechanism preferably contains a crankshaft 77 driven by an electric motor (not shown) or other suitable power source to move the drive element 20 in a reciprocal motion. The drive element is connected to the crankshaft by a connecting rod 78.

Fluid is preferably supplied to the inlet fitting 22 through a quick-disconnect coupling 80 having a stationary portion 82 affixed to the inlet fitting 22 and a movable portion 84 affixed to a supply hose 86 running to the fluid supply reservoir (not shown). The stationary portion 82 and the movable portion 84 are joined along complementary faces 88 and 90, respectively, and have respective primary passages (92 and 94) and secondary passages (96 and 98) which communicate with one another. Thus, the primary passage 92 of the stationary portion 82 communicates with the primary passage 94 of the movable portion 84 to join a supply passage 100 of the supply hose 86 to the inlet fitting 22. Similarly, the secondary passage 96 of the stationary portion 82 communicates with the secondary passage 98 of the movable portion 84 to join a return passage 102 of the supply hose to the return conduit 76 of the priming system. The primary passages 92 and 94 preferably extend axially through their respective elements to minimize restriction in the main supply circuit of the pump, whereas the secondary passages can be more restrictive because they operate only during the priming phase.

In order to form a tight seal between the two portions 82 and 84 of the quick-disconnect coupling 82, at least one of the two complementary faces 88 and 90 is preferably made of resilient material, such as nylon or neoprene. Sealing contact between the two faces is then obtained by a screw thread mechanism 104 which clamps the two faces together.

Figure 4:
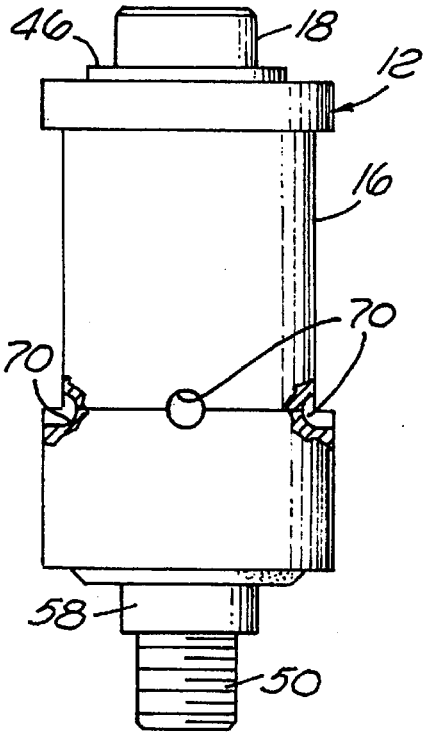
FIG. 4 is a front elevational view of a modular fluid subassembly of the pump of FIG. 1.
Figure 5A:
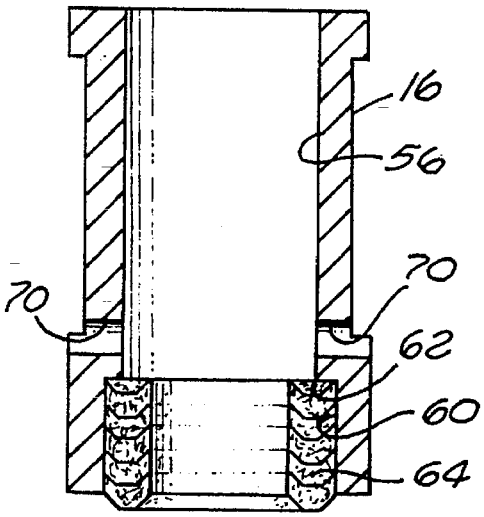
FIG. 5A is a vertical sectional view of a cylindrical pump body of the subassembly of FIG. 4.
Figure 5B:
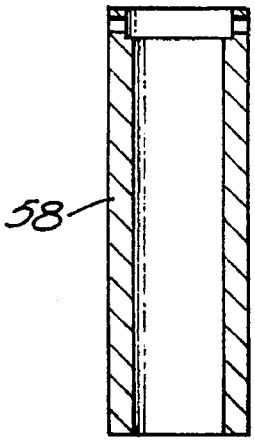
FIG. 5B is a vertical sectional view of a sleeve structure of the subassembly of FIG. 4.
Figure 5C:
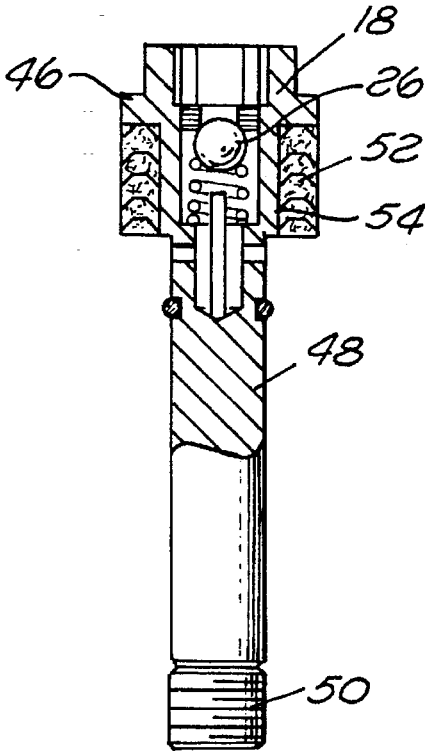
FIG. 5C is a partial vertical sectional view of a piston of the subassembly of FIG. 4.

In operation, the piston 18 and the pump body 16 cooperate to pump fluid efficiently in a two-stroke cycle, as described above. When servicing is required, the movable portion 84, of the quick-disconnect coupling 80 is removed and the inlet fitting is threaded out of the pump housing 14 to reveal the modular subassembly 12. After disengaging the piston 18 from the drive element 20 by rotating it from its upper end with a wrench or other suitable tool, the subassembly 12 can be removed. In this condition, it appears as illustrated in FIG. 4. The friction of the packings 52 and 64 holds the various elements of the subassembly together so they can be removed as a unit and replaced easily. Once the modular subassembly is removed, the substantially cylindrical pump body 16 can be slid off the piston 18 and the sleeve 58 to reveal the packings 52 and 64 for replacement (FIG. 5A). The packing 52 of the piston 18 can be removed after the sleeve itself is slid off the stem 48 (FIGS. 5B and 5C).

In an alternative embodiment of the invention, the quick-disconnect coupling 80 is replaced by an open hopper (not shown) containing a large volume of paint. In yet another embodiment, the quick-disconnect coupling 80 is replaced by an inlet tube with a paint filter screen (not shown), and the entire arrangement is inverted so the inlet tube points downward into a bucket of paint.

Although the foregoing embodiments are disclosed as typical, it will be understood that additional variations, substitutions and modifications can be made to the system, as disclosed, without departing from the scope of the invention. Thus, the present invention has been described by way of illustration and not limitation. For example, it is not necessary that the piston 18 have a hexagonal head or a hexagonal recess; any arrangement by which torque can be applied to piston 18 to screw it from drive element 20 will suffice. Nor is it necessary that the engagement between the piston 18 and drive element 20 be a threading engagement; any sufficiently strong engagement mechanism that can be operated from the upper end of the piston 18 will suffice. In fact, the entire assembly can be inverted, if desired, without loss of function. Similarly, while FIG. 1 depicts the inlet fitting 22 as being threaded into the pump housing 14, other constructions are possible. For example, the upper fitting 22 can be bolted to the pump housing, with an o-ring seal therebetween.

What is claimed is:

1. A double-displacement fluid pump comprising:

a reciprocating drive element;

a pump housing adjacent the drive element, said pump housing having inner walls defining an opening therein; and a modular fluid subassembly comprising:

a substantially cylindrical pump body disposed within said opening, said pump body having outer walls defining an exterior surface with a recess therein and inner walls defining a pump bore; and a piston received within said pump bore and releasably coupled to said drive element for reciprocal movement therewith;

the inner walls of the pump housing combining with the outer walls of the pump body to form an outlet fluid cavity of the pump having a substantially annular region at least partially surrounding the pump body, said substantially annular region being formed at least partially by said recess.

2. The double-displacement fluid pump of claim 1 wherein:

the piston is threadingly coupled to the drive element and the pump body is substantially cylindrical.

3. The double-displacement fluid pump of claim 1 wherein:

said substantially annular region is formed at least in part by a recess in the inner walls of the pump housing.

4. The double-displacement fluid pump of claim 1 wherein:

a pressure control apparatus communicates with said outlet fluid cavity through the pump housing.

5. The double-displacement fluid pump of claim 1 wherein:

a priming apparatus communicates with said outlet fluid cavity through the pump housing.

6. A double-displacement fluid pump comprising:

a reciprocating drive element;

a pump housing adjacent the drive element, said pump housing having inner walls defining an opening therein; and a modular fluid subassembly comprising:

a substantially cylindrical pump body disposed within said opening, said pump body having outer walls defining an exterior surface with a recess therein and inner walls defining a pump bore;

a piston received within said pump bore and releasably coupled to said drive element for reciprocal movement therewith;

the piston comprising a stem having an elongated shank extending axially from a flange to an end portion coupled to said drive element; a fluid sealing structure on the shank abutting said flange; and a sleeve received over the shank between the fluid sealing structure and the drive element; and the inner walls of the pump housing combining with the outer walls of the pump body to form an outlet fluid cavity of the pump.

7. The double-displacement fluid pump of claim 6 wherein:

the end portion of said stem is threadingly coupled to the drive element to compress said fluid sealing structure.

8. The double-displacement fluid pump of claim 1 which further comprises:

at least one check valve.

9. A double-displacement fluid pump comprising:

a drive apparatus having a reciprocating drive element;

a pump housing having inner walls defining an opening therethrough extending from a first end adjacent the drive element to a second end remote from the drive element;

a modular fluid subassembly comprising:

a substantially cylindrical pump body received within said opening with one end of the pump body adjacent said first end of the pump housing and another end of the pump body adjacent said second end of the pump housing, said pump body having outer walls defining an exterior surface with a recess therein and inner walls defining a pump bore;

a piston received within said pump bore and releasably coupled to said drive element for reciprocal movement therewith; and an inlet fitting closing the second end of the pump body to retain the modular fluid subassembly within said opening and introduce fluid into the subassembly;

the inner walls of the pump housing combining with the outer walls of the pump body to form an outlet fluid cavity of the pump having a substantially annular region at least partially surrounding the pump body, said substantially annular region being formed at least partially by said recess.

10. The double-displacement fluid pump of claim 9 wherein:

said substantially annular region is formed at least in part by a recess in the inner walls of the pump housing.

11. The double-displacement fluid pump of claim 9 wherein:

a pressure control apparatus communicates with said outlet fluid cavity through the pump housing.

12. The double-displacement fluid pump of claim 9 wherein:

a priming apparatus communicates with said outlet fluid cavity through the pump housing.

13. The double-displacement fluid pump of claim 11 which further comprises:

a first check valve within said inlet fitting; and a second check valve within said piston;

the first check valve serving to admit fluid to the pump body during a first operating stroke of the fluid pump and the second check valve serving to expel a portion of the admitted fluid to said outlet fluid cavity on a second, return stroke.

14. The double-displacement fluid pump of claim 9 wherein:

the piston is threadingly coupled to the reciprocal drive element for removal of the modular fluid subassembly from the pump housing as a unit when the inlet fitting is removed.

15. The double-displacement fluid pump of claim 9 wherein:

said inlet fitting is threaded to the pump housing.

16. A double-displacement fluid pump comprising a drive apparatus having a reciprocating drive element;

a pump housing having inner walls defining an opening therethrough extending from a first end adjacent the drive element to a second end remote from the drive element;

a modular fluid subassembly comprising:

a substantially cylindrical pump body received within said opening with one end of the pump body adjacent said first end of the pump housing and an other end of the pump body adjacent said second end of the pump housing, said pump body having outer walls defining an exterior surface and inner walls defining a pump bore;

a piston received within said pump bore and releasably coupled to said drive element for reciprocal movement therewith;

the piston comprising a stem having an elongated shank extending axially from a flange to an end portion coupled to said drive element; a fluid sealing structure on the shank abutting said flange; and a sleeve received over the shank between the fluid sealing structure and the drive element; and an inlet fitting closing the second end of the pump body to retain the modular fluid subassembly within said opening and introduce fluid into the subassembly;

the inner walls of the pump housing combining with the outer walls of the pump body to form an outlet fluid cavity of the pump.

17. The double-displacement fluid pump of claim 16 wherein:

the end portion of said stem is threadingly coupled to the drive element to compress said fluid sealing structure.

18. A double-displacement fluid pump comprising:

a drive apparatus having a reciprocating drive element;

a pump housing having inner walls defining an opening therethrough extending from a first end adjacent the drive element to a second end remote from the drive element;

a modular fluid subassembly comprising:

a substantially cylindrical pump body received within said opening with one end of the pump body adjacent said first end of the pump housing and an other end of the pump body adjacent said second end of the pump housing, said pump body having outer walls defining an exterior surface and inner walls defining a pump bore;

a piston received within said pump bore and releasably coupled to said drive element for reciprocal movement therewith; and an inlet fitting closing the second end of the pump body to retain the modular fluid subassembly within said opening and introduce fluid into the subassembly;

the inner walls of the pump housing combining with the outer walls of the pump body to form an outlet fluid cavity of the pump; and the inner walls of the pump bore have a primary diameter adjacent said second end of the pump housing and are provided with a step to a region of larger diameter adjacent said first end of the pump housing to accommodate a fluid sealing structure, said fluid sealing structure being compressed between the step and the first end of the pump housing when the modular fluid subassembly is within the pump housing.

19. A double-displacement fluid pump comprising:

a drive apparatus having a reciprocating drive element;

a pump housing having inner walls defining an opening therethrough extending from a first end adjacent the drive element to a second end remote from the drive element;

a modular fluid subassembly comprising:

a substantially cylindrical pump body received within said opening with one end of the pump body adjacent said first end of the pump housing and an other end of the pump body adjacent said second end of the pump housing, said pump body having outer walls defining an exterior surface and inner walls defining a pump bore;

a piston received within said pump bore and releasably coupled to said drive element for reciprocal movement therewith; and an inlet fitting closing the second end of the pump body to retain the modular fluid subassembly within said opening and introduce fluid into the subassembly;

the inner walls of the pump housing combining with the outer walls of the pump body to form an outlet fluid cavity of the pump; and said inlet fitting including a quick-disconnect coupling providing a primary passage for the supply of new fluid from a external fluid conduit and a secondary passage for returning excess fluid to a second external conduit fluid reservoir.

20. The double-displacement fluid pump of claim 19 wherein:

said quick-disconnect coupling has a stationary portion mounted to the inlet fitting and a movable portion receivable within the stationary portion, the stationary portion and the movable portion engaging one another at a pair of complementary faces to form said primary and secondary passages.

21. The double-displacement fluid pump of claim 20 wherein:

said primary passage extends through the center of said complementary faces; and said secondary passage is located at the periphery of said faces.

22. The double-displacement fluid pump of claim 21 wherein:

one of said complementary faces is formed of resilient material; and said secondary passages include a groove extending at least partially around said primary opening in one of said complementary faces.

23. The double-displacement fluid pump of claim 22 wherein:

said stationary portion includes a screw thread mechanism to urge said complementary faces together in a fluid sealing relationship.

* * * * *